US005381675A

United States Patent [19]

Siegel

[11] Patent Number: 5,381,675

[45] Date of Patent: Jan. 17, 1995

[54] FORCE-SPARING BALANCED BELLOWS REFRIGERATION DEVICE

[76] Inventor: Israel Siegel, 2980 Point E. Dr., Apt. D-612, N. Miami Beach, Fla. 33160

[21] Appl. No.: 116,579

[22] Filed: Sep. 7, 1993

[51] Int. Cl.[6] ..... F25B 1/00

[52] U.S. Cl. ..... 62/498; 62/268; 62/467; 417/473

[58] Field of Search ..... 417/472, 473; 62/467, 62/498, 510, DIG. 2, 218, 268

[56] References Cited

U.S. PATENT DOCUMENTS

| | | | |
|---|---|---|---|
| 2,051,450 | 9/1960 | Fischer | 417/473 |
| 3,539,277 | 11/1970 | Andrews et al. | 417/473 |
| 5,141,412 | 8/1992 | Meinz | 417/473 |

FOREIGN PATENT DOCUMENTS

| | | | |
|---|---|---|---|
| 975954 | 10/1950 | France | 62/498 |

OTHER PUBLICATIONS

McQuiston et al., Heating Ventilating and Air Conditioning, 1982, pp. 574–575.

*Primary Examiner*—John M. Sollecito

[57] ABSTRACT

The force sparing temperature changer operates through at least two air evacuated bellows. The relative positions of the chambers are such that the moving walls of the chambers face each other and transmit opposing vector forces to each other. This causes the movable walls of the bellows to settle in positions which are the result of the balance of opposing forces upon the walls. An outside reciprocal vector force upon the movable walls tips the balance of the opposing forces upon the movable walls and causes a reciprocal expansion and compression of each chamber. The bellows chambers contain a low boiling point liquid, such as water under a vacuum, which responds to the the expansion and compression of the chambers. The cooling effects of the expansion of the chambers upon the low boiling point liquid are separated from the heating effects of the compression of the chambers, by separate tubings and one way valves.

9 Claims, 1 Drawing Sheet

FORCE-SPARING BALANCED BELLOWS REFRIGERATION DEVICE

BACKGROUND AND OBJECTIVES

The invention relates to devices which use mechanical energy for cooling and heating purposes, and in particular to improvements in reciprocal bellows type evaporative cooling systems and heat pumps. An objective of the present invention is to provide a bellows type cooling and heating system which uses less force and energy than standard bellows temperature changing systems. Another objective of the present invention is to provide a cooling system which can use water instead of freon. Another objective is to provide cooling and heating systems which are adapted to operate under low refrigerant pressures, and low temperature differentials between the heat source and the heat sink. Another objective of the present invention is to provide an expander-compressor which is especially adapted to miniature cooling and heating devices, such as those which can be used in micro-climate cooling and heating systems. Another objective is to provide a force and energy sparing transmission of movement between an air evacuated enclosure and the atmosphere.

All compressor type evaporative temperature systems consist of 1. a low boiling point liquid used as a refrigerant and 2. the components involved in the generation and transmission of mechanical energy to compress and expand the vapors of the refrigerant. Most standard compressor type cooling systems use chlorinated hydrocarbons as low boiling point refrigerants (freons). The freons are hazardous because they damage the atmospheric ozone layer.

The boiling point of water can be lowered to freezing temperatures by an air vacuum. Under an air vacuum the water can, therefore, function as a low boiling point refrigerant. Water has several advantages over freon. It is non-toxic to the environment. it is cheaper than freon, and its latent heat of vaporization is higher than that of freon. In addition to the above, water operates at lower pressures and at lower pressure differentials (between the relatively cold and relatively hot portions of the compression types cooling and heating systems) than freons. They therefore require less force to operate than freon based systems. The main disadvantage of using water as a low boiling point refrigerant is the fact that the lowering of the boiling point of the water requires an air vacuum. This requires the housing of the water in a chamber from which the air has been evacuated. Mechanical force must then be transmitted to the water vapors through the walls of the chamber enclosing the air vacuum. Force transmitting means which pierce the surface of the air evacuated chamber increase the chances of leakage of air into the chamber and cancellation of the air vacuum. The most convenient force transmitting means which do not pierce the surface consist of bellows walls which increase and decrease the volume of the chamber. This requires a moving bellows wall surface which is exposed in its inner side to the vacuum and in its outer side to the atmosphere, This requires an investment of power to overcome atmospheric pressure upon the outside of the moving wall during the expansion phase of the reciprocal movements of the wall. The present invention provides means whereby atmospheric resistance to the movement of the wall is overcome without the investment of man made energy sources.

The invention is based upon the fact that force follows the path of least resistance. The direction of any force can, therefore, be controlled by the regulation of the resistance to the flow of the force. In the present invention an atmospheric force, or a vapor force, which provides a resistance to the movement of the movable wall of a bellows chamber, is balanced and neutralized by an atmospheric force, or a vapor force, which is made to flow in the opposite direction. Electric power is, therefore, not required to overcome the resistances. Since work is equal to force times displacement the present invention uses less electric energy to obtain a given displacement than conventional bellows compressor systems, when the temperatures and the refrigerants in the devices are identical.

In addition to the above, the fact that the position of the movable walls of the compressor expander can be changed by a tipping of a balance of opposing forces, causes the moving walls to be responsive to very small outside forces. The balanced bellows compressor-expander is, therefore, responsive to lower pressure ranges than single standard bellows compressors (see numerical example).

SUMMARY

Two bellows chambers which compress and expand in response to inside and outside pressure act as a compressor-expander. The chambers are positioned relative to each other in a way which causes the movable walls of the chambers to face each other, and to travel in opposite directions. The movable walls of the two chambers are attached to each other so that each movable wall transmits an opposing vector force to the other movable wall. The distance between the chambers is fixed to prevent the movements of the chambers towards and away from each other and to provide space for the movements of the flexible walls between the chambers. When the pressures in the chambers are below atmospheric pressure the movable walls of the chamber exert opposing pulling vector forces on each other. When the pressures in the chambers are above atmospheric pressures the movable walls of the chamber exert opposing pushing vector forces on each other. The walls settle in a position between the chambers which is the result of the balance of the opposing vector forces acting upon the walls. A reciprocal outside vector force upon the movable walls tips the balance between the movable walls and moves the walls in the directions of the applied force. This causes a reciprocal expansion and compression of each chamber. The bellows chambers contain a low pressure refrigerant such as water under a vacuum, or a high pressure refrigerant, such as freons or Forane which respond to the the expansion and compression of the chambers. During the expansion phase the low boiling point liquid evaporates in the evaporator chamber and absorbs heat from its surrounding. During the compression phase the condenser chamber delivers heat to its surroundings. The vapor re-condenses into a liquid in the condenser chamber and accumulates in the bottom of the condenser. When the liquid reaches a predetermined level it activates a float valve, and the water returns to the evaporator chamber by force of gravity to continue the heat exchange cycle. The cooling effects of the expansions of the bellows chambers are separated from the heating effects of the compressions of the bellows chamber by a system of tubes and one way valves.

FIG. 1 is a cross section of a preferred embodiment of the temperature changer.

DETAILED DESCRIPTION

Figure 1:
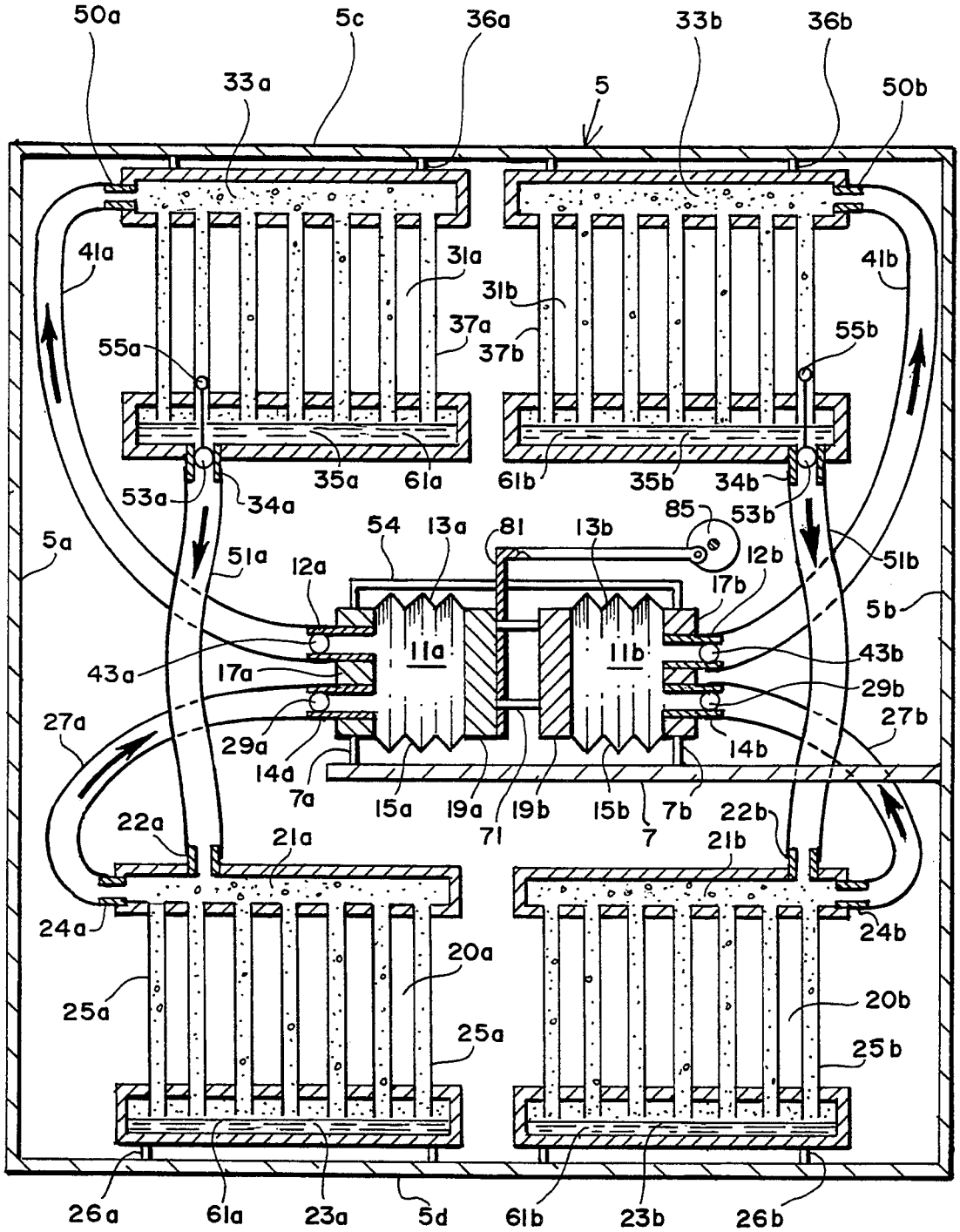

As seen in FIG. 1 there is present a frame 5 with side walls 5a and 5b, top wall 5c, and bottom wall 5d. Extending from side wall 5b is a frame wall branch 7. Present on top of the left side of frame branch V is a bellows chamber 11a. The chamber contains a top wall 13a, a bottom wall 15a, and side walls 17a and 19a. Side wall 17a is immobile and is attached to wall branch 7 through frame wall extension 7a. Top and bottom walls 13a and 15a consist of bellows which allow side wall 19a to move to the left and to the right in a reciprocating manner. When wall 19a moves to the right bellows walls 13a and 15a change from a folded to and extended position, This increases the volume of chamber 11a. When wall 19a moves to the left bellows walls 13a and 15a change from an extended to a folded position. This decreases the volume of chamber 11a. The size and number of the folds in the bellows are such that the bellows allows a sufficient distance of travel of wall 19a. The natural bias of the bellows walls flexibility tends to keeps walls 13a and 15a in a folded position. The wails of chamber 11a are made of good insulating materials such as plastic to prevent an exchange of heat between bellows chamber 11a and the environment. Penetrating chamber 11a through the immovable wall 17a are an outlet tube 12a and an inlet tube 14a.

Present on top of the left side of frame wall 5d is a network of heat exchange tubes 20a. The network functions as an evaporator chamber, as will be explained. The net work consists of a top horizontal tube 21a, a bottom horizontal tube 23a, and vertical tubes 25a. Penetrating the top wall of cylinder 21a is inlet tube 22a. The arrangement is that all vertical tubes 25a communicate with both horizontal tubes 21a and 23a. Network 20a is fixed in a position by frame extensions 26a which extend from the top of wall 5d to the bottom of horizontal tube 23a. The tubes and coils of network 20a are made of good heat conducting materials, such as copper, to allow for a maximal transfer of heat from the walls of the tubes to the outside environment. Means such as surface extensions (not shown) to increase the area of the heat exchange surfaces may be used. Penetrating horizontal tube 21a is an outlet tube 24a. Communicating between inlet tube 14a of chamber 11a and outlet tube 24a of horizontal tube 21a is a tube 27a. A one way valve 29a in tube 14a allows the exit of vapor from tube 21a to chamber 11a, but blocks the entrance of vapor from chamber 11a to tube 21a.

Present on the inside left side of top frame wall 5c is a net work of heat-exchange tubes 31a. The network functions as a condenser chamber, as will be explained. The net work consists of a top horizontal tube 33a, a bottom horizontal tube 35a, and vertical tubes 37a. The arrangement is that all the vertical tubes 37a communicate with both horizontal tubes 33a and 35a. Network 31a is fixed in a position by frame extensions 36a of top frame wall 5c. The extensions 36a extend from the inside surface of wall 5c and are attached to the top surface of 33a. The tubes and coils of network 31a are made of good heat conducting materials, such as copper, to allow for a maximal transfer of heat from the walls of the tubes to the outside environment. Means such as surface extensions (not shown) to increase the area of the heat exchange surfaces may be used. Penetrating horizontal tube 33a is an inlet tube 50a. Communicating between inlet tube 50a of horizontal tube 33a and outlet tube 12a of chamber 11a is a tube 41a. A one way valve 43a in inlet tube 12a allows the entrance of vapor from chamber 11a to cylinder tube 33a, but blocks the entrance of vapor from tube network 31a to chamber 11a. Penetrating the bottom wall of horizontal cylinder 35a is outlet tube 34a.

Communicating between tubes 22a and tube 34a is a tube 51a. A floatation valve 53a, present in the tubes 34a, opens and closes tube 51a. Attached to valve 53a is a float 55a. The arrangement is that the float responds to a liquid level in vertical tubes 37a, so that when the liquid reaches a predetermined level in tubes 37a float 55a rises and opens valve 53a. This allows a transfer of liquid from network 31a to network 20a by force of gravity.

Present inside networks 20a and 31a is an air vacuum and low boiling point liquid, such as water 61a. The air vacuum lowers the boiling point of the water, and enhances the evaporation of the water, as will be described.

Present on top of the right side of wall branch 7 is a chamber 11b. Chamber 11b is a duplicate of chamber 11a and its components have been given similar numbers marked by the subscript b instead of a. As seen in FIG. 1 chamber 11b contains a top wall 13b, a bottom wall 15b, and side walls 17b and 19b. The duplicate chambers 11a and 11b are placed in positions, relative to each other, which cause the movable side walls 19a and 19b to face each other. Side wall 17b is immobile and is attached to branch 7 through frame wall extension 7b.

Top and bottom walls 13b and 15b consist of bellows which allow side wall 19b to move to the left and to the right in a reciprocating manner. When wall 19b moves to the left away from wall 17b, bellows walls 13b and 15b change from a folded to and extended position. This increases the volume of chamber 11b. When wall 19b moves to the right, towards wall 17b, bellows walls 13b and 15b change from an extended to a folded position. This decreases the volume of chamber 11b. The size and number of the folds in the bellows are such that the bellows allows a sufficient distance of travel of side wall 19b. The natural bias of the bellows walls tends to keep the bellows walls in a folded position. The walls of chamber 11b are made of good insulating materials such as plastic to prevent an exchange of heat between bellows chamber 11b and the environment. Penetrating chamber 11b through the immovable wall 19b are an outlet tube 12b and an inlet tube 14b.

Present on the right side of frame wall 5d is a network of heat exchange tubes 20b. The network functions as an evaporator chamber, as will be explained. Network 20b is a duplicate of network 20a and its components have been given similar numbers marked by the subscript b. The net work consists of a top horizontal tube 21b, a bottom horizontal tube 23b, and vertical tubes 25b. The arrangement is that all the vertical tubes 25b communicate with tubes 21b and 23b. Network 20a is fixed in a position by frame extensions 26b which extend from the top of wall 5d to the bottom of horizontal tube 23b. The tubes and coils of network 20b are made of good heat conducting materials, such as copper, to allow for a maximal transfer of heat from the walls of the tubes to the outside environment. Means such as surface extensions (not shown) to increase the area of the heat exchange surfaces may be used. Penetrating the side wall of cylinder 21b is an outlet tube 24b. Communicating between inlet tube 14b of chamber 11b and outlet tube 24b of horizontal tube 21b is a tube 27b. A one way valve 29b in tube 14b allows the exit of vapor from tube 21b to chamber 11b but blocks the entrance of vapor from chamber 11b to tube 21b. Network 20b functions as an evaporator chamber, as will be described. Penetrating the top wall of horizontal cylinder 21b is inlet tube 22b.

Present on the inside right side of top frame wall 5c is a net work of heat-exchange tubes 31b. The network functions as a condenser chamber, as will be explained. Network 31b is a duplicate of network 31a and its components have been given similar numbers marked by the subscript b. Net work 31b consists of a top horizontal tube 33b, a bottom horizontal tube 35b, and vertical tubes 37b. The arrangement is that all the vertical tubes 37b communicate with both tubes 33b and 35b. Network 31b is fixed in a position by frame extensions 36b of top frame wall 5c. The tubes and coils of network 31b are made of good heat conducting materials, such as copper, to allow for a maximal transfer of heat from the walls of the tubes to the outside environment. Means such as surface extensions (not shown) to increase the area of the heat exchange surfaces may be used. Penetrating horizontal tube 33b is an inlet tube 50b. Communicating between inlet tube 50b of horizontal tube 33b and outlet tube 12b of chamber 11b is a tube 41b. A one way valve 43b in tube 12b allows the entrance of vapor from chamber 11b to tube 33b, but blocks the entrance of vapor from tube 33b to chamber 11b. Penetrating the bottom wall of horizontal cylinder 35b is outlet tube 34b.

Communicating between tubes 22b and tube 34b is a tube 51b. A floatation valve 53b, present in the tube 34b, opens and closes tube 34b. Attached to valve 53b is a float 55b. The arrangement is that the float responds to a liquid level in vertical tubes 37b, so that when the liquid reaches a predetermined level in tubes 37b float 55b rises and opens valve 53b. This allows a transfer of liquid from network 31b to network 20b by force of gravity.

Present inside networks 20b and 31b is an air vacuum and low boiling point liquid, such as water 61b. The air vacuum lowers the boiling point of the water, and enhances the evaporation of the water, as will be described.

Present between movable walls 19a and 19b, at a 90 degree angle to the walls, are horizontal rods 71. The rods are permanently attached to walls 19a and 19b and transmit a vector force from one wall to another, as will be explained. Chambers 11a and 11b are kept at a predetermined fixed distance from each other by the attachments of the bottoms of immovable side 17a and 17b to branch support 7, as previously described. In addition, the distance between chambers 11a and 11b is fixed by rods 54 which are attached to the tops of side walls 17a and 17b of the chambers. The distance between the chambers is such that each of bellows walls 13a, 13b, 15a, and 15b are pulled to about half of their expansion potential. This allows an equal left and right distance of travel by movable walls 19a and 19b between the chambers. The arrangement is such that, when the walls travel to the left and to the right, between chambers 11a and 11b, one bellows chamber expands while the other bellows chamber contracts. Attached to the outer surface of wall 19a is a rod 81. The rod is connected, by standard crank and shaft means 85, to a standard motor (not shown) to reciprocally move walls 19a and 19b to the left and to the right between chambers 11a and 11b, as will be described.

The operation of the engine when low boiling point liquid 61a and 61b consists of water is as follows. The Liquid evaporates in chambers 11a and 11b, and exerts a vapor pressure upon the inside walls of the chamber. Since force follows the path of least resistance the vapors exert a force that moves movable wall 19a to the right and movable wall 19b to the left. In contrast, the atmospheric pressure outside the chambers pushes wall 19a to the left, and wall 19b to the right. When refrigerant 61a consists of water the vapor pressure inside the chamber at ambient temperature is below atmospheric pressure. The net atmospheric force will, therefore, push wall 19a to the left and wall 19b to the right. Movable walls 19a and 19b will transmit these opposing vector forces to each other through rods 71. This will cause the movable walls to exert a pulling vector force upon each other. Thus, each wall will be subjected to a pushing vector force by the outside atmosphere, and a pulling vector force in the opposite direction by the movable wall of its adjacent container. When the temperatures in the chambers are equal to each other, the atmospheric push upon each wall is equal to the opposing pulling force by its adjacent wall. The opposing forces upon the walls will then cancel each other. The positions of walls 19a and 19b will then be determined primarily by the equal inherent flexibility of bellows 19 and 39. The inherent flexibility of the bellows will tend to keep the bellows in a folded position. This, however, is prevented by the fixed distance between the chambers which stretch the bellows to a half folded position. The walls will then rest in a position between the chambers determined by the the balance of the flexible forces upon the walls.

When crank and shaft 85 are activated by an electric motor the rotary force provided by the motor is translated to a reciprocal right and left pressure upon movable walls 19a and 19b. When this occurs the balance of forces upon the walls is tipped and the walls move in the direction of the applied force. For example, when rod 81 pushes walls 19a and 19b to the right the force which moves the walls to the right becomes larger than the force which moves the walls to the left. This will initiate a movement of the walls to the right. This enlarges chamber bellows 11a, and contracts chamber bellows 11b. This increases the volume of the vapor in container 11a and decreases the volume of the vapor in container 11b. The expansion of the vapor in container 11a results in a reduction of the vapor pressure in the container to below the vapor pressures in networks 20a and 31a. A portion of the vapor in network 20a will, therefore, leave network 20a through tube 27a and valve 29a to enter chamber 11a. In contrast to the vapors of network 20a, the vapors of network 31a are not effected when chamber 11a expands, because of one way valve 43a which prevents the exit of vapor from network 31a. The remaining vapor in network 20a then expands to fill the volume of the network. The expansion of the vapor induces a reduction in the temperature of the vapor and an additional evaporation of low boiling point liquid 61a in network 20a. The evaporation of the liquid causes the liquid to lose some of its heat content and to cool the coils of network 20a.

While the right movement of rod 81 increases the volume of chamber bellows 11a, it decreases the volume of chamber bellows 11b. This compresses the vapor in the chamber. The compression of the vapor in container 11*b* results in a increase of the vapor pressure in the container to above the vapor pressures in networks 20*b* and 31*b*. A portion of the vapor in chamber 11*b* will therefore enter condenser network 31*b* through tube 41*b* and valve 43*b*. In contrast to the vapors of the condenser chamber network 31*b*, the vapors of network 20*b* are not effected when chamber 11*b* contracts, because of one way valve 29*b* which prevents the entrance of vapor from 11*b* to network 20*b*. The entrance of additional vapor into network 31*b* will compress the vapor in network. This causes a temperature increase of the vapor to above ambient temperature. This causes the vapor to lose some of its heat content to the environment through the walls of the condenser chamber. Some of the vapor in 31*b* then re-condenses into a liquid. The re-condensed liquid accumulates in the lower portion of network 31*b*. As the level of the water rises in vertical tubes 25*b* the water lifts float 55*b*. When the float reaches a predetermined level it opens valve 53*b*. When this occurs the re-condensed liquid returns to network 20*b* through tube 51*b* by force of gravity.

When rod 81 moves to the left it moves walls 19*a* and 19*b* to the left. This enlarges chamber bellows 11*b*, and contracts chamber bellows 11*a*. This increases the volume of the vapor in container 11*b* and decreases the volume of the vapor in container 11*a*. The expansion of the vapor in container 11*b* results in a reduction of the vapor pressure in the container to below the vapor pressures in networks 20*b* and 31*b*. A portion of the vapor in network 20*b* will, therefore, leave network 20*b* through tube 27*b* and valve 29*b* to enter chamber 11*b*. The remaining vapor in network 20*b* then expands to fill the volume of the network. The expansion of the vapor induces a reduction in the temperature of the vapor and an additional evaporation of the low boiling point liquid in the network. The evaporation of the liquid causes the liquid to lose some of its heat content and to cool the coils of network 20*b*. In contrast to the vapors of network 20*b*, the vapors of network 31*b* are not effected when chamber 11*b* expands, because of one way valve 43*b* which prevents the exit of vapor from network 31*b*.

The decrease in the volume of chamber bellows 11*a* compresses the vapor in the chamber. The compression of the vapor in container 11*a* results in a increase of the vapor pressure in the container to above the vapor pressures in networks 20*a* and 31*a*. A portion of the vapor in chamber 11*a* will therefore enter condenser network 31*a* through tube 41*a* and valve 43*a*. The entrance of additional vapor into network 31*a* will compress the vapor in the network. This causes a temperature increase of the vapor to above ambient temperature. This causes the vapor to lose some of its heat content to the environment through the walls of the condenser chamber. Some of the vapor in 31*a* then re-condenses into a liquid. The re-condensed liquid accumulates in the lower portion of network 31*a*. As the water accumulates in vertical tubes 25*a* it lifts float 55*a*. When the float reaches a predetermined level it opens valve 53*a*. When this occurs the recondensed liquid returns to network 20*a* through tube 51*a* by force of gravity. In contrast to the vapors of the condenser chamber network 31*a*, the vapors of network 20*a* are not effected when chamber 11*a* contracts, because of one way valve 29*a* which prevents the entrance of vapor to network 20*a*.

While the present embodiment of the invention has utilized water under an air vacuum as the refrigerant, it is understood that a variety of other refrigerants such as Forane® 134A (tetrafluroethane) (F3CCH2F), an ozone sparring compound may be used without departing from the essence of the invention. When the vapor pressure of the refrigerant exceeds atmospheric pressure the movable walls of the bellows chambers will exert a pushing force upon each other instead of a pulling force. The balance of forces between the moving walls will result from opposing pushing actions by the movable walls instead of opposing pulling forces. The structures and operation of the invention will be exactly as described for FIG. 1. This may be useful in temperature changing systems which operate through a relatively low pressure differential between expansion and compression pressures, such as those which produce a relatively small change in ambient temperature (numerical example 2).

It is understood that, depending on where the evaporators 20*a* and 20*b* and the condensers 31*a* and 31*b*, are placed, the invention can be used as either a cooling device or a heating device. When the invention serves as a cooling device the evaporators are placed in an enclosure or area which is to be cooled, while the condensers are placed outside of the enclosure, where the heat of the condenser is dissipated as waste heat. In contrast, when the invention serves as a heating device the evaporators are placed in an enclosure or area which requires an increase in the temperature, while the evaporators are placed outside of the enclosure, where the cooling effects of the evaporators are dissipated. Alternatively, the evaporators may be placed in an enclosure which require a decrease in temperature, while the condensers may be placed in and enclosure which requires an increase in temperature and the invention can serve simultaneously as both a cooling and heating device. Proper heat distributing devices such as fans may be used.

NUMERICAL EXAMPLES

The minimum force required to move the movable walls of the balanced bellows expander-compressor is calculated according to formula $(c-ev)\times a$, where c is equal to the vapor pressure of the condenser chamber, ev is equal to the vapor pressure in the evaporator chamber, and a is equal to the area of the movable wall.

The minimal force required to expand a conventional single air evacuated bellows chamber containing vapor pressures which are below atmospheric pressures is calculated according to the formula $(at-ev)\times a$, where at is equal to atmospheric pressure, ev is equal to the vapor pressure in the evaporator chamber, and a is equal to the area of the movable wall.

The minimal force required to compress a conventional single air evacuated bellows chamber containing vapor pressures which are above atmospheric pressures is calculated according to the formula $(c-at)\times a$, where c is equal to the vapor pressure in the condenser chamber, at is equal to atmospheric pressure, and a is equal to the area of the movable wall.

EXAMPLE 1
FORCE REDUCTION BY BALANCED BELLOWS WITH WATER AS REFRIGERANT

| Temperature and Water Vapor Pressure | | Force Required Kg/10 cm | | Energy saved by |
|---|---|---|---|---|
| in Evaporator | in Condenser | Balanced bellows | Single bellows | Balanced bellows |
| A) 70 F., 0.026 Kg/cm | 105 F., 0.078 Kg/cm | 0.52 | 10.13 | 94.91% |
| B) 50 F., 0.0125 Kg/cm | 105 F., 0.078 Kg/cm | 0.65 | 10.235 | 93.65% |
| C) 50 F., 0.0125 Kg/cm | 115 F., 0.098 Kg/cm | 0.85 | 10.235 | 91.7% |
| D) 32 F., 0.006 Kg/cm | 105 F., 0.078 Kg/cm | 0.72 | 10.30 | 93.0% |
| E) 32 F., 0.006 Kg/cm | 130 F., 0.078 Kg/cm | 1.56 | 10.30 | 85.86% |

EXAMPLE 2
FORCE REDUCTION BY BALANCED BELLOWS WITH FORANE AS REFRIGERANT

| Temperature and Forane Vapor Pressure | | Force Required Kg/10 cm | | Energy saved by |
|---|---|---|---|---|
| in Evaporator | in Condenser | Balanced bellows | Single bellows | Balanced bellows |
| a) 80 F., 7.14 Kg/cm | 93 F., 8.81 Kg/cm | 16.7 | 77.7 | 78.5% |
| b) 70 F., 6.04 Kg/cm | 105 F., 10.55 Kg/cm | 45.1 | 95.1 | 52.6% |
| c) 50 F., 5.64 Kg/cm | 105 F., 10.55 Kg/cm | 49.1 | 95.1 | 49.4% |
| d) 32 F., 1.49 Kg/cm | 105 F., 10.55 Kg/cm | 90.6 | 95.1 | 4.7% |
| e) 32 F., 1.49 Kg/cm | 130 F., 15.06 Kg/cm | 13.57 | 140 | 3.1% |

What is claimed is:

1. A force sparing temperature changing system, said temperature changing system includes at least two bellows chambers, a movable wall in each of said bellows chamber, wherein said movable walls move in response to expansions and compressions of the bellows of said bellows chamber, a refrigerant consisting of a low boiling point liquid communicating with said bellows chambers, a total pressure inside of said chambers which is different from the pressure outside of said bellows chambers, relative positions of said bellows chambers which cause said movable walls to move in opposite directions, a linkage between said movable walls wherein said linkage transmits movement from one of said movable to the other, a predetermined distance between said bellows chambers, said distance being of a dimension which forces each of said movable wall to rest in an operational energy-independent position which is between the potential limits of travel of said walls, and wherein said position is determined by the balance of opposing forces upon said movable walls, means to transmit an outside vector force to at least one of aid movable walls to tip said balance of opposing forces, wherein said vector force acts in a direction which forces the expansion of one of said bellows chambers and the compression of the other of said bellows chambers, and means to separate the cooling effects which occur during said expansion of said bellows chamber from the heating effects which occur during said compression of said bellows chamber.

2. The invention as described in claim 1 wherein the means to separate said cooling effects from said heating effects consists of at least one evaporator and one condenser chamber communicating with each of said bellows chamber, valve means in said communication between said bellows chambers and said condenser chambers, said valve means allowing an entry from said bellows chamber to said condenser chambers but preventing an entry from said condenser chambers to said bellows chambers, valve means in said communication between said bellows chambers and said evaporator chambers, said valve means preventing an entry from said evaporator chambers to said bellows chambers, but allowing an entry from said bellows chambers to said evaporator chambers, and means to return re-condensed liquid from said condenser chambers to said evaporator chambers.

3. The invention as described in claim 1, said movable walls are attached to each other.

4. The invention as described in claim 1 wherein said total pressures in said bellows chamber are less than atmospheric pressure, and wherein said movable walls exert opposing pulling forces upon each other before operational energy is applied the system.

5. The invention as described in claim 1 wherein said total pressures in said bellows chamber are above atmospheric pressure, and wherein said movable walls exert opposing pushing forces upon each other before operational energy is applied the system.

6. The invention as described in claim 1, wherein said low boiling point liquid is water.

7. The invention as described in claim 3 wherein the means to separate said cooling effects from said heating effects consists of at least one evaporator and one condenser chamber communicating with each said bellows chamber, valve means in said communication between said bellows chambers and said condenser chambers, said valve means allowing an entry from said bellows chambers to said condenser chambers but preventing an entry from said condenser chambers to said bellows chambers, communicating with each said bellows chamber, valve means in said communication between said bellows chambers and said condenser chambers, said valve means allowing an entry from said bellows chambers to said condenser chambers but preventing an entry from said condenser chambers to said bellows chambers, valve means in said communication between said bellows chambers and said evaporator chambers, said valve means preventing an entry from said evaporator chambers to said bellows chambers, but allowing an entry from said bellows chamber to said evaporator chambers, and means to return re-condensed liquid from said condenser camber to said evaporator chamber.

8. The invention as described in claim 3 wherein said low boiling point liquid is water.

9. A force sparing temperature changing system, said temperature changing system includes at at least two bellows chambers, a movable wall in each of said bellows chambers, wherein said movable walls move in response to expansions and compressions of the bellows of said bellows chamber, a refrigerant consisting of a low boiling point liquid which has an operating vapor pressure which is below atmospheric pressure communicating with each of said bellows chamber, a total pressure in the interior of each of said bellows chambers which is less than outside atmospheric pressure, wherein each of said movable walls is pushed by atmospheric pressure in a direction which compresses its bellows chambers, relative positions of said bellows chambers which causes said movable walls move in opposite directions, an attachment between said movable walls which transmits a pulling action from each of said movable walls to the other, a fixed distance between said chambers, said distance being of a dimension which forces said linked movable walls into an operational energy-independent position between the potential distance of travel of said walls, wherein said position is the result of a balance of opposing pulling forces upon said walls, means to transmit an outside vector force to at least one of said movable walls wherein said vector force acts in a direction which tips said balance and forces the expansion of one of said bellows chambers and the compression of the other of said bellows chambers, and means to separate the cooling effects which occur during said expansion of said bellows chamber from the heating effects which occur during said compression of said bellows chamber.

* * * * *